US005828345A

United States Patent [19]

Waterman et al.

[11] Patent Number: 5,828,345

[45] Date of Patent: Oct. 27, 1998

[54] ELECTRICALLY SHORT WIDE-BAND, WIDE-SCAN, SLOW WAVE DUAL NOTCH RADIATOR

[75] Inventors: Timothy Waterman, Eldersburg, Md.; John Vezmar, Garner, N.C.; James Yon, Bowie, Md.

[73] Assignee: Northrop Grumman Corporation, Los Angeles, Calif.

[21] Appl. No.: 745,982

[22] Filed: Nov. 8, 1996

[51] Int. Cl.[6] ..... H01Q 13/10

[52] U.S. Cl. ..... 343/770; 343/767; 343/700 MS

[58] Field of Search ..... 343/770, 767, 343/700 MS, 850, 853, 862, 864, 768; H01Q 1/38, 13/10

[56] References Cited

U.S. PATENT DOCUMENTS 4,873,528 10/1989 Girard ..... 343/770

5,365,244 11/1994 Yon et al. ..... 343/767

5,600,337 2/1997 Cassel ..... 343/770

5,627,550 5/1997 Sanad ..... 343/700 MS

*Primary Examiner*—Hoanganh T. Le

*Attorney, Agent, or Firm*—Walter G. Sutcliff

[57] ABSTRACT

A dual notch radiating antenna includes a pair of notch cavities having respective slow wave structures extending into the notch cavities. The slow wave structures effectively shorten the length of the dual notch antenna. The dual notch antenna also includes a pair of front end impedance transformers respectively coupled to open ends of the notch cavities. A passageway is coupled between the impedance transformers near the open ends of the corresponding notch cavities. The passageway provides an alternative shorter path for leakage current from one notch cavity to the other notch cavity, thus greatly reducing the likelihood of an effective short circuit occurring at a signal supply port of the dual notch antenna.

28 Claims, 2 Drawing Sheets

ELECTRICALLY SHORT WIDE-BAND, WIDE-SCAN, SLOW WAVE DUAL NOTCH RADIATOR

FIELD OF THE INVENTION

The present invention relates to a dual notch radiator antenna that is electrically short and is capable of wide-scan in both the E-plane and the H-plane over a very wide band. The dual notch radiator antenna can be arranged as a single polarization antenna or may be egg-crated for dual polarization with little or no degradation in performance.

DESCRIPTION OF THE BACKGROUND ART

Dual polarized antenna arrays which are required to scan with equal magnitude in both the E-plane and the H-plane tend to have a fundamental problem related to square element spacing so as not to favor either plane. A requirement of such an antenna is that a free space impedance of approximately 400 ohms at broadside must be fed from a low impedance transmission line system (typically approximately 50 ohms) from behind the array.

Dual notch antennas are commonly used as components of dual polarized antenna arrays. Dual notch antennas typically have impedance transformers at the front end and an impedance splitter provided as a feed which is also used to transform the impedance. The impedance transformation for a typical dual notch antenna is done over a very wide band. However, these methods of impedance transformation cause problems since the antenna can effectively short-circuit itself when the antenna is scanned in the E-plane along an elevation.

U.S. Pat. No. 5,365,244 to Yon et al discloses a wide band notch antenna which achieves necessary impedance transformation using a notched stripline transmission line between parallel ground planes of the antenna, and by providing a final impedance transformation segment suspended within the notch cavity or balun. However, the impedance transformation segment suspended in the notch cavity is subjected to significant cross polarization radiation, which may significantly degrade performance of the antenna.

SUMMARY OF THE INVENTION

Accordingly, a primary object of the present invention is to provide an antenna which may be used in a dual-polarized array and which may be scanned in both the E-plane and the H-plane without shorting itself out when scanned in the E-plane.

It is a further object of the present invention to provide an antenna which may be used in a dual-polarized array that can be appreciably shortened and made compact.

It is a still further object of the present invention to provide an antenna which may be used in a dual-polarized array which can scan farther.

These and other objects of the present invention are fulfilled by providing an antenna having first and second ground planes oriented parallel with respect to each other and formed of conductive material, a plurality of connecting planes attached to and connecting the first and second grounding planes;

first and second notches formed in the first and second ground planes, each of the first and second notches having an open end and an opposite closed end;

a transmission line, disposed between the first and second ground planes, having a first end coupled to a signal source, the transmission line branching into first and second lines which respectively span across the open ends of the first and second notches and which subsequently terminate in respective first and second open circuits between the first and second ground planes, the first and second lines within the open ends of the first and second notches respectively radiating electromagnetic waves;

first and second transformers, each having a first end and an opposite second end such that the first ends of the first and second transformers are respectively coupled to the open ends of the first and second notches and the second ends of the first and second transformers are open to space, the first and second transformers respectively transforming an impedance of electromagnetic waves radiated from the first and second notches and passing the transformed electromagnetic waves out of the antenna via the second ends of the first and second transformers; and a passage disposed between the first and second transformers for providing an alternative shorter path for the electromagnetic waves between the first and second transformers.

The passage disposed between the first and second transformers creates a shorter path for current leaking from one notch to the other notch, preventing creation of an effective short-circuit of the antenna and enabling the antenna to scan farther.

The above described and other objects of the present invention are also fulfilled by providing an antenna having first and second ground planes oriented parallel with respect to each other and formed of conductive material, a plurality of connecting planes attached to and connecting the first and second grounding planes;

first and second notches formed in the first and second ground planes, each of the first and second notches having an open end and an opposite closed end;

a transmission line, disposed between the first and second ground planes, having a first end coupled to a signal source, the transmission line branching into first and second lines which respectively span across the open ends of the first and second notches and which subsequently terminate in respective first and second open circuits between the first and second ground planes, the first and second lines within the open ends of the first and second notches respectively radiating electromagnetic waves toward the closed ends of the first and second notches;

delay structures mounted within the first and second notches for delaying the electromagnetic waves radiated from the first and second lines;

first and second transformers, each having a first end and an opposite second end such that the first ends of the first and second transformers are respectively coupled to the open ends of the first and second notches and the second ends of the first and second transformers are open to space, the first and second transformers respectively transforming an impedance of electromagnetic waves radiated from the first and second notches and passing the transformed electromagnetic waves out of the antenna via the second ends of the first and second transformers; and a passage disposed between the first and second transformers for providing an alternative shorter path for the electromagnetic waves between the first and second transformers.

The passage disposed between the first and second transformers creates a shorter path for current leaking from one notch to the other notch, preventing the creation of an effective short-circuit of the antenna and enabling the antenna to scan farther. The slow wave structures within the notches, which may be a plurality of thin walls extending from surface portions of the notch, allows the overall length of the antenna structure to be appreciably shortened.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF THE PREFERRED EMBODIMENTS

In a planar array antenna or two-dimensional antenna array, the radiating elements are arranged in a rectangular or square structure with each element being spaced an equal distance apart. The antenna operates over a selected bandwidth with the radiating elements preferably spaced about a half wavelength apart at the highest frequency of the bandwidth. It is to be understood that the dual notch antenna to be described hereinafter is not necessarily limited as usable only in an antenna array. The dual notch antenna may be used as a single radiating element.

Figure 1:
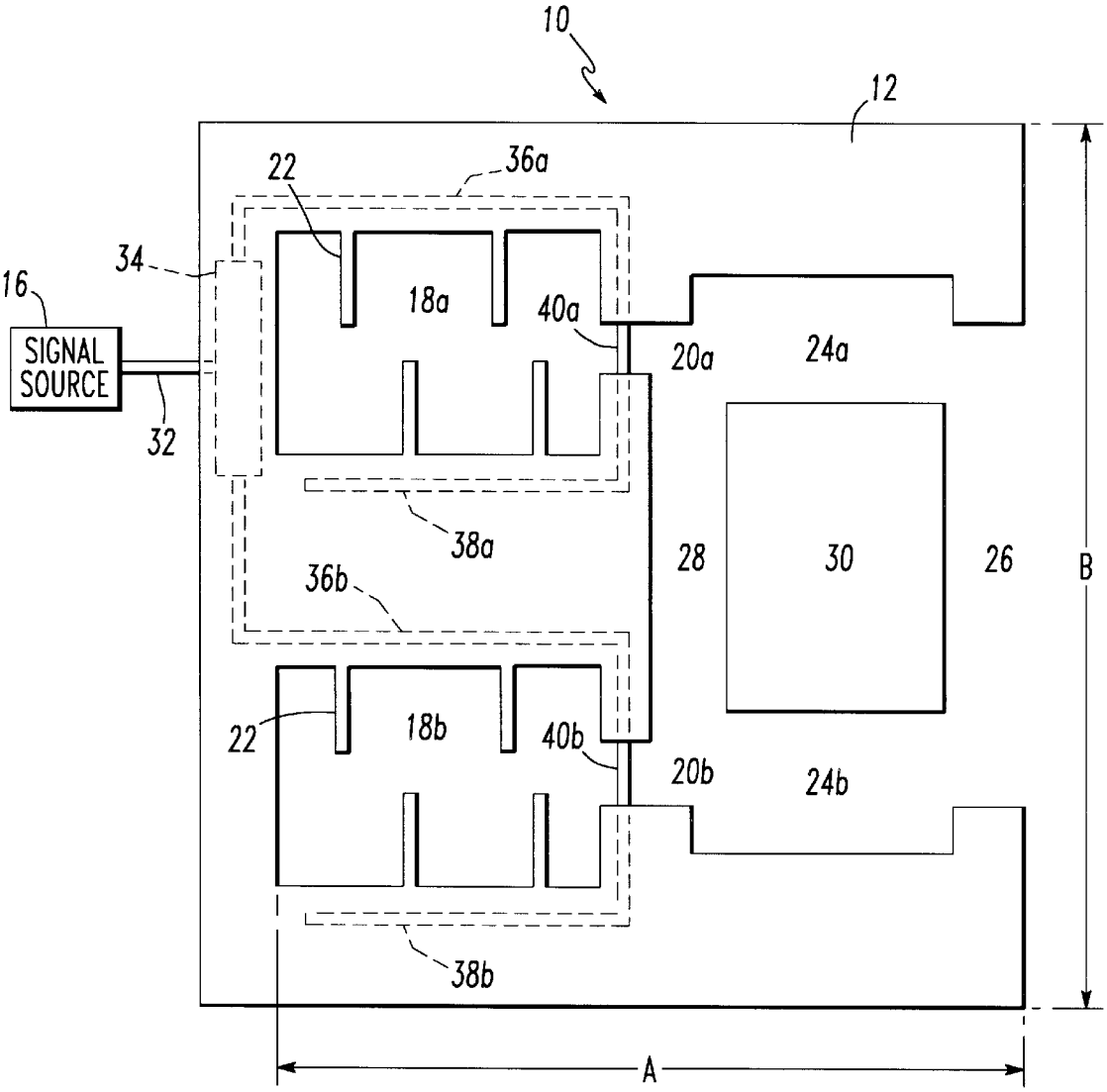
FIG. 1 illustrates a dual notch radiator of a preferred embodiment of the present application.
Figure 2:
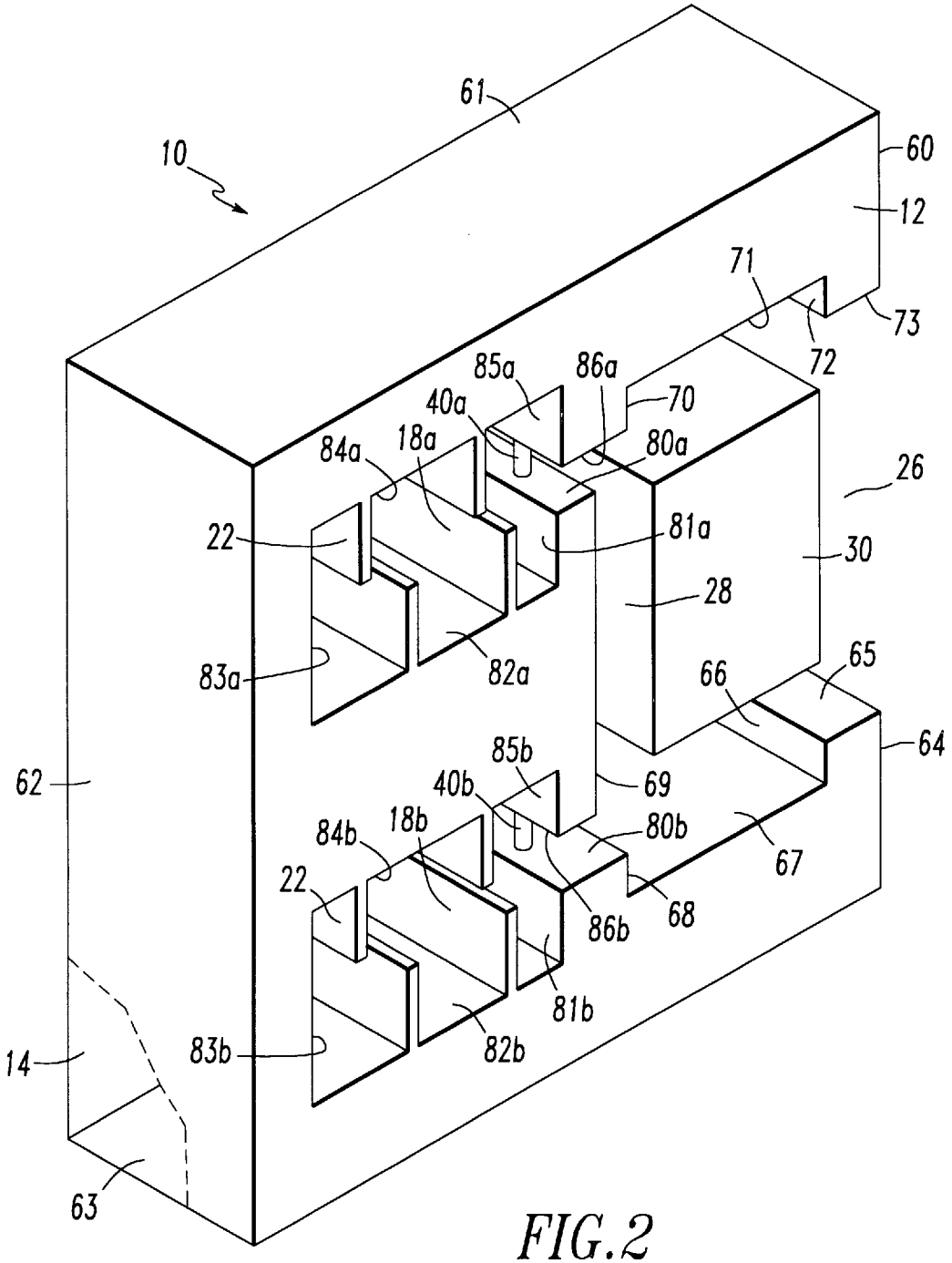
FIG. 2 illustrates a plan view of the dual notch antenna of the FIG. 1 embodiment.

FIGS. 1 and 2 illustrate a preferred embodiment of a dual notch antenna of the present application. The radiating element generally denoted as 10 is comprised of two parallel, similarly shaped opposing ground planes 12 and 14. Ground planes 12 and 14 are each made of a conductive material such as aluminum, copper, gold or silver, or any suitable conductive material as would be understood by one of ordinary skill. Ground planes 12 and 14 are separated and held apart by an insulating material such as plastic beads, honeycombed cardboard or any other nonconducting material that is suitable to support ground planes 12 and 14 apart from each other.

Element 10 generally has an exaggerated E-shape with aperture 26 located at a front end of the element as a radiator. First and second notch cavities or baluns 18*a* and 18*b* are formed at a rear end of the element. Each of the notch cavities 18*a* and 18*b* have an open end and an opposite closed end. The structure of notch cavity 18*a* (which is the same as notch cavity 18*b*) comprises open end 20*a* and is formed of several transverse connecting planes 80*a*–86*a*. Notch rear connecting plane 83*a* connects ground planes 12 and 14 at the end of notch cavity 18*a* farthest from notch opening 20*a*.

Element 10 also includes transverse connecting planes 60 –64 along the exterior thereof. First and second impedance transformers 24*a* and 24*b* are formed subsequent respective notch cavities 18*a* and 18*b* at the front end of element 10. Respective first ends of impedance transformers 24*a* and 24*b* are coupled to open ends 20*a* and 20*b* of notch cavities 18*a* and 18*b*.

Impedance transformers 24*a* and 24*b* include respective second ends, opposite the first ends, which are open to free space via aperture 26. Transverse connecting planes 65–68 and 70–73 connect ground planes 12 and 14 along the interior of impedance transformers 24*a* and 24*b*.

A passageway 28 is formed between impedance transformers 24*a* and 24*b*. Transverse connecting plane 69 connects ground planes 12 and 14 along the interior portion of passageway 28. Floating conductive parasitic block 30 separates impedance transformers 24*a* and 24*b*. A rigid, honeycomb material such as cardboard may be placed within impedance transformers 24*a* and 24*b* and passageway 28, maintaining floating conductive parasitic block 30 in a stable position between impedance transformers 24*a* and 24*b*.

Signal source 16 as illustrated in FIG. 1 is located at a position outside of radiating element 10 so as not to obstruct the radiating field. Signal source 16 is coupled to element 10 via transmission line 32. Any particular type of signal source 16 and transmission line 32 can be used as would be understood by any one of ordinary skill. Typically, transmission line 32 would have a relatively low impedance of approximately 50 ohms. Transmission line 32 is coupled to impedance splitter 34, which is sandwiched between ground planes 12 and 14 and which is therefore illustrated by dashed line.

The circuitry within element 10 which couples the signal from signal source 16 to open ends 20*a* and 20*b* of notch cavities 18*a* and 18*b* may essentially comprise a conductive strip of material disposed between ground planes 12 and 14. In a preferred embodiment, the transmission lines may be a strip line comprising an etched conductor on a dielectric substrate. In an alternative embodiment, the transmission line may simply comprise a solid metal conductor supported between ground planes 12 and 14 by an insulating material that is suitable for supporting the conductors without signal degradation.

Impedance splitter 34 branches the incoming signal delivered from signal source 16 on transmission line 32 to conductor 36*a* beside notch cavity 18*a* and to conductor 36*b* beside notch cavity 18*b*. Conductor 36*a* is coupled to a first end of wire 40*a* which spans across open end 20*a* of notch cavity 18*a*. In a likewise manner, conductor 36*b* is coupled to a first end of wire 40*b* which spans across open end 20*b* of notch cavity 18*b*. A second end of wire 40*a* is coupled to conductor 38*a* at the other side of opening 20*a*. Conductor 38*a* terminates in an open circuit a quarter wavelength back at midband. Likewise, a second end of wire 40*b* is coupled to conductor 38*b* at the other side of open end 20*b* of notch cavity 18*b*. Conductor 38*b* terminates in an open circuit approximately a quarter wavelength back at midband.

Each of notch cavities 18*a* and 18*b* include a plurality of slow wave structures 22 which extend into notch cavities 18*a* and 18*b*. Respective pairs of slow wave structures 22 extend from transverse connecting planes 82*a* and 84*a* into notch cavity 18*a*. Similarly, respective pairs of slow wave structures 22 extend from transverse connecting planes 82*b* and 84*b* into notch cavity 18*b*.

Slow wave structures 22 within notch cavities 18*a* and 18*b* effectively shorten the length of the notch cavities. For example, upon supply of a signal from signal source 16 to element 10 via transmission line 32, the applied signal is split at impedance splitter 34 along conductors 36*a* and 36*b*. Particularly with respect to notch cavity 18*a*, upon application of a signal along conductor 36*a*, a potential difference is created at the first and second ends of wire 40*a* which spans across open end 20*a* of notch cavity 18*a*. An electromagnetic wave is radiated from wire 40*a* in a direction toward impedance transformer 24*a* and in a direction toward rear connecting plane 83*a*. The electromagnetic wave which radiates toward rear connecting plane 83*a* travels along the corresponding surfaces of transverse connecting planes 82*a* and 84*a* and along the corresponding surfaces of the slow wave structures 22. The electromagnetic wave subsequently reflects off rear connecting plane 83*a* back toward open end 20*a* of notch cavity 18*a* along the corresponding surfaces of connecting planes 82*a* and 84*a* and along the corresponding surfaces of slow wave structures 22 to collect in-phase with the electromagnetic wave radiated from wire 40*a* in the direction toward impedance transformer 24*a*. An electromagnetic wave is radiated from wire 40*b* which spans across open end 20*b* of notch cavity 18*b* in a similar manner as described with respect to notch cavity 18*a* to provide a collected electromagnetic wave radiated toward transformer 24*b*.

Slow wave structures 22 function to effectively shorten the length of notch cavities 18*a* and 18*b* by effectively increasing the surface area that the electromagnetic waves must traverse over when passing back and forth along the corresponding notch cavity. This feature of the preferred embodiment advantageously enables the length of element 10 to be shortened such that the dual notch antenna may be made more compact. The length slow wave structures 22 extend into notch cavities 18*a* and 18*b* is selected so as to optimize electromagnetic wave delay and cavity impedance. For example, if the length slow wave structures extend into the notch cavity is too short, insufficient delay of the electromagnetic wave would result, necessitating increased notch cavity length. Moreover, if slow wave structure length is too great, effective cavity impedance would be decreased, thus limiting bandwidth.

In a preferred embodiment, the dual notch antenna having slow wave structures 22 within notch cavities 18*a* and 18*b* has a dimension A from the rear connecting planes 83*a* and 83*b* to the opening of aperture 26 of approximately $\lambda/8$ at a lowest frequency of the selected band. In a preferred embodiment, dimension A was approximately 3. 86 inches and the highest frequency of the antenna would generally be four times that of the lowest operating frequency.

It is to be understood that the length of notch cavity 18*a*, for instance, from rear connecting plane 83*a* to open end 20*a* should optimally approach $\lambda/4$ at midband. This would necessitate an increased number of slow wave structures within the notch cavity. On the other hand, in order to optimize impedance of the notch cavity, the slow wave structures should optimally be placed as far apart as possible. Accordingly, the number and positioning of the slow wave structures within the notch cavity are selected to optimize operation of the antenna while balancing the above-noted competing interests.

Dimension B along the front end aperture opening 26 across both notch cavities 18*a* and 18*b* for the above-noted preferred embodiment was approximately 4.4 inches. The use of slow wave structures 22 results in appreciable shortening of the length of notch cavities 18*a* and 18*b* by approximately 40%, which allows impedance splitter 34 to be moved closer to aperture 26. As the distance between impedance splitter 34 and aperture 26 is decreased, the likelihood of an antenna short circuit decreases, thus enabling the antenna to scan farther in elevation. It is to be understood that the particular dimensions as given above are illustrative only and are not to be considered as limiting. The dimensions will of course differ depending upon the selected bandwidth and upon the number of slow wave structures within notch cavities 18*a* and 18*b*.

A further feature of a preferred embodiment of the present application concerns passageway 28 which is coupled across impedance transformer 24*a* and impedance transformer 24*b*. When the dual notch antenna as illustrated in FIGS. 1 and 2 is implemented in a planar array having a plurality of dual notch antennas stacked vertically and horizontally, the planar array can be steered electronically to radiate an electromagnetic beam broadside if the particular signal supplied to the corresponding dual notch antennas are fed in phase. During such normal operation when the signals supplied to the dual notch antennas of the array are in phase, passageway 28 serves as an effective short circuit such that no current components of the radiated electromagnetic waves flow from open end 20*a* of notch cavity 18*a* to open end 20*b* of notch cavity 18*b* or vice versa. The radiated electromagnetic waves from notch cavities 18*a* and 18*b* radiate outward through aperture 26 via impedance transformers 24*a* and 24*b* respectively.

On the other hand, in order to provide scanability in both the E-plane and H-plane (elevational and azimuthal), the antenna array can be electronically steered by changing the phase of the signal supplied to a particular dual notch antenna relative to the phase of the signal applied to a next dual notch antenna within the planar array. As a result of steering in the E-plane, different respective potentials are developed at the respective first and second ends of lines 40*a* and 40*b* which span across open ends 20*a* and 20*b* of notch cavities 18*a* and 18*b*.

Upon steering in the E-plane electronically in a conventional dual notch antenna which does not include passageway 28 of the illustrated embodiments of the present application, a portion of the current from the electromagnetic wave radiated from a first notch cavity would tend to leak from a corresponding impedance transformer along the exit aperture into the corresponding other impedance transformer 24*b*, entering the corresponding other notch cavity. This leakage current would at certain phase angles create an effective short circuit at the feed of an impedance splitter of the conventional dual notch antenna. An effective short circuit would tend to occur for signals at a higher end of the transmission band. Under the conditions of an effective short circuit, output power of the dual notch antenna is severely reduced.

Passageway 28 between impedance transformer 24*a* and 24*b* as illustrated in FIGS. 1 and 2 provides an alternative shorter path for leakage current between notch cavity 18*a* and notch cavity 18*b*. Accordingly, upon electronically steering the beam in the E-Plane of the dual notch antenna when implemented in a planar array for example, the likelihood of an effective short circuit occurring at the feed of impedance splitter 34 is greatly reduced since the amount of phase shift in degrees along passageway 28 is insufficient to render an effective short circuit. This enables the dual notch antenna to scan farther.

A further advantage of the dual notch antenna as illustrated in FIGS. 1 and 2 relates to the use of impedance transformers 24*a* and 24*b* at a front end of element 10 subsequent notch cavities 18*a* and 18*b*. This eliminates the need of suspending a transformer segment within notch cavities 18*a* and 18*b* and therefore significantly reduces cross polarization radiation.

Accordingly, the present invention provides a dual notch antenna capable of transmitting in a wider band in both the E-plane and the H-plane at a very short depth. The dual notch antenna of the preferred embodiment is scannable in the E-plane such that the likelihood of an effective short circuit occurring at the signal feed is very unlikely.

The invention being thus described, it will be obvious that the same may be varied in many ways. For example, the dual notch antenna may be used independently or in a planar array. Also, the passageway which provides a shorter alternative path may be used without the slow-wave structures, and vice-versa. Such variations are not to be regarded as a departure from the spirit and scope of the invention, and all such modifications as would be obvious to one skilled in the art are intended to be included within the scope of the following claims.

What is claimed is:

1. An antenna comprising:

first and second ground planes oriented parallel with respect to each other and formed of conductive material, a plurality of conductive connecting planes attached to and connecting said first and second ground planes;

first and second notches formed in said first and second ground planes, each of said first and second notches having an open end and an opposite closed end;

a transmission line, disposed between said first and second ground planes, having a first end coupled to a signal source, said transmission line branching into first and second lines which respectively span across the open ends of said first and second notches and which subsequently terminate in respective first and second open circuits between said first and second ground planes, said first and second lines within the open ends of said first and second notches respectively radiating electromagnetic waves;

delay means mounted within said first and second notches for delaying the electromagnetic waves radiated from said first and second lines toward the closed ends of said first and second notches;

first and second transformers, each having a first end and an opposite second end such that the first ends of said first and second transformers are respectively coupled to the open ends of said first and second notches and the second ends of said first and second transformers are open to space, said first and second transformers respectively transforming an impedance of electromagnetic waves radiated from said first and second notches and passing the transformed electromagnetic waves out of the antenna; and a passage disposed between said first and second transformers for providing an alternative shorter path for the electromagnetic waves between said first and second transformers.

2. The antenna of claim 1, wherein said first and second lines also radiate the electromagnetic waves directly into said first and second transformers.

3. The antenna of claim 2, wherein the closed ends of said first and second notches respectively reflect the electromagnetic waves which radiate from said first and second lines back toward the open ends of said first and second notches.

4. The antenna of claim 1, wherein said transmission line is stripline.

5. The antenna of claim 1, wherein said delay means comprise slow wave structures which extend into said first and second notches for increasing the surface area within said first and second notches.

6. The antenna of claim 1, further comprising impedance splitting means for branching said transmission line into said first and second lines.

7. An antenna comprising:

first and second ground planes oriented parallel with respect to each other and formed of conductive material, a plurality of conductive connecting planes attached to and connecting said first and second ground planes;

first and second notches formed in said first and second ground planes, each of said first and second notches having an open end and an opposite closed end;

a transmission line, disposed between said first and second ground planes, having a first end coupled to a signal source, said transmission line branching into first and second lines which respectively span across the open ends of said first and second notches and which subsequently terminate in respective first and second open circuits between said first and second ground planes, said first and second lines within the open ends of said first and second notches respectively radiating electromagnetic waves;

first and second transformers, each having a first end and an opposite second end such that the first ends of said first and second transformers are respectively coupled to the open ends of said first and second notches and the second ends of said first and second transformers are open to space, said first and second transformers respectively transforming an impedance of electromagnetic waves radiated from said first and second notches and passing the transformed electromagnetic waves out of the antenna; and a passage disposed between said first and second transformers for providing an alternative shorter path for the electromagnetic waves between said first and second transformers.

8. The antenna of claim 7, wherein said first and second lines within the open ends of said first and second notches respectively radiate the electromagnetic waves toward the closed ends of said first and second notches and also directly into said first and second transformers.

9. The antenna of claim 8, further comprising delay means mounted within said first and second notches for delaying the electromagnetic waves radiated respectively from said first and second lines toward the closed ends of said first and second notches.

10. The antenna of claim 9, wherein said delay means comprise slow wave structures which extend into said first and second notches for increasing the surface area within said first and second notches.

11. The antenna of claim 10, wherein the closed ends of said first and second notches respectively reflect the electromagnetic waves which radiate from said first and second lines back toward the open ends of said first and second notches.

12. The antenna of claim 7, wherein said transmission line is stripline.

13. The antenna of claim 7, further comprising impedance splitting means for branching said transmission line into said first and second lines.

14. An antenna comprising:

first and second ground planes oriented parallel with respect to each other and formed of conductive material, a plurality of conductive connecting planes attached to and connecting said first and second ground planes;

first and second notches formed in said first and second ground planes, each of said first and second notches having an open end and an opposite closed end;

a transmission line, disposed between said first and second ground planes, having a first end coupled to a signal source, said transmission line branching into first and second lines which respectively span across the open ends of said first and second notches and which subsequently terminate in respective first and second open circuits between said first and second ground planes, said first and second lines within the open ends of said first and second notches respectively radiating electromagnetic waves;

delay means mounted within said first and second notches for delaying the electromagnetic waves radiated from said first and second lines toward the closed ends of said first and second notches;

first and second transformers, each having a first end and an opposite second end such that the first ends of said first and second transformers are respectively coupled to the open ends of said first and second notches and the second ends of said first and second transformers are open to space, said first and second transformers respectively transforming an impedance of electromagnetic waves radiated from said first and second notches and passing the transformed electromagnetic waves out of the antenna; and means for preventing an effective short circuit at the first end of said transmission line, said means for preventing being coupled between said first and second transformers.

15. The antenna of claim 14, wherein said first and second lines also radiate the electromagnetic waves directly into said first and second transformers.

16. The antenna of claim 15, wherein the closed ends of said first and second notches respectively reflect the electromagnetic waves which radiate from said first and second lines back toward the open ends of said first and second notches.

17. The antenna of claim 14, wherein said means for preventing comprises a passage disposed between said first and second transformers for providing an alternative shorter path for the electromagnetic waves between said first and second transformers.

18. The antenna of claim 14, wherein said transmission line is stripline.

19. The antenna of claim 14, wherein said delay means comprise slow wave structures which extend into said first and second notches for increasing the surface area within said first and second notches.

20. The antenna of claim 14, further comprising impedance splitting means for branching said transmission line into said first and second lines.

21. An antenna comprising:

first and second ground planes oriented parallel with respect to each other and formed of conductive material, a plurality of conductive connecting planes attached to and connecting said first and second ground planes;

first and second notches formed in said first and second ground planes, each of said first and second notches having an open end and an opposite closed end;

a transmission line, disposed between said first and second ground planes, having a first end coupled to a signal source, said transmission line branching into first and second lines which respectively span across the open ends of said first and second notches and which subsequently terminate in respective first and second open circuits between said first and second ground planes, said first and second lines within the open ends of said first and second notches respectively radiating electromagnetic waves;

first and second transformers, each having a first end and an opposite second end such that the first ends of said first and second transformers are respectively coupled to the open ends of said first and second notches and the second ends of said first and second transformers are open to space, said first and second transformers respectively transforming an impedance of electromagnetic waves radiated from said first and second notches and passing the transformed electromagnetic waves out of the antenna; and means for preventing an effective short circuit at the first end of said transmission line, said means for preventing being coupled between said first and second transformers.

22. The antenna of claim 21, wherein said first and second lines within the open ends of said first and second notches respectively radiate the electromagnetic waves toward the closed ends of said first and second notches and also directly into said first and second transformers.

23. The antenna of claim 22, further comprising delay means mounted within said first and second notches for delaying the electromagnetic waves radiated respectively from said first and second lines toward the closed ends of said first and second notches.

24. The antenna of claim 23, wherein said delay means comprise slow wave structures which extend into said first and second notches for increasing the surface area within said first and second notches.

25. The antenna of claim 24, wherein the closed ends of said first and second notches reflect the electromagnetic waves which radiate from said first and second lines back toward the open ends.

26. The antenna of claim 21, wherein said means for preventing comprises a passage disposed between said first and second transformers for providing an alternative shorter path for the electromagnetic waves between said first and second transformers.

27. The antenna of claim 21, wherein said transmission line is stripline.

28. The antenna of claim 21, further comprising impedance splitting means for branching said transmission line into said first and second lines.

* * * * *